US007737839B1

(12) United States Patent
Jones

(10) Patent No.: US 7,737,839 B1
(45) Date of Patent: Jun. 15, 2010

(54) SYSTEM AND METHOD FOR PROTECTING POCKET-PORTABLE ELECTRONIC DEVICES

(75) Inventor: Bryce A. Jones, Overland Park, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 335 days.

(21) Appl. No.: 12/011,076

(22) Filed: Jan. 24, 2008

(51) Int. Cl.
*G08B 1/08* (2006.01)

(52) U.S. Cl. ..... 340/539.11; 340/539.1; 340/572.1; 340/679

(58) Field of Classification Search ..... 340/539.11, 340/539.1, 572.1, 572.8, 679
See application file for complete search history.

(56) References Cited

U.S. PATENT DOCUMENTS

| | | | | |
|---|---|---|---|---|
| 6,862,496 | B2 * | 3/2005 | Fukuoka et al. | 700/237 |
| 2005/0258961 | A1 * | 11/2005 | Kimball et al. | 340/572.1 |
| 2006/0225302 | A1 * | 10/2006 | Lyu et al. | 34/595 |
| 2007/0001005 | A1 * | 1/2007 | White et al. | 235/451 |
| 2007/0123177 | A1 * | 5/2007 | Jeong et al. | 455/90.1 |
| 2009/0072991 | A1 * | 3/2009 | Hayashi et al. | 340/825 |
| 2009/0126123 | A1 * | 5/2009 | Kim et al. | 8/137 |

FOREIGN PATENT DOCUMENTS

| | | |
|---|---|---|
| JP | 2006129916 | 5/2006 |

* cited by examiner

*Primary Examiner*—Daryl Pope

(57) ABSTRACT

A clothes washing machine is specially adapted to protect pocket-portable electronic devices from damage. A basket is aligned with an opening for receiving clothes to be washed. A door covers the opening during washing of clothes. An electromagnetic loop is positioned at the periphery of the opening so that all clothing loaded into the clothes washing machine passes through the electromagnetic loop. The electromagnetic loop is also positioned so that no permanent ferrous structures of the clothes washing machine are located between the electromagnetic loop and the opening. A detector circuit is coupled to the electromagnetic loop for generating an electronic detection signal in response to a predetermined change in an electromagnetic characteristic sensed across the electromagnetic loop corresponding to a pocket-portable electronic device being present at the opening. A washing machine controller coupled to the detector circuit responds to the detection signal to generate an alarm and to inhibit a washing cycle (e.g., introduction of water into the basket) until a user provides a manual override signal to the washing machine controller.

19 Claims, 3 Drawing Sheets

SYSTEM AND METHOD FOR PROTECTING POCKET-PORTABLE ELECTRONIC DEVICES

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to clothes washing machines, and, more specifically, to electronic circuits for clothes washing machines for protecting sensitive electronic consumer devices in the event that they are accidentally placed into a washing machine.

Advances in electronics have led to the proliferation of many consumer electronic devices carried for personal use by their users. These devices include cellular phones, digital cameras, multimedia players such as MP3 players, and personal digital assistance (PDAs). The miniaturization of these devices has made them "pocket portable" whereby a consumer carries them in a shirt or pants pocket.

Although these consumer electronic devices can normally withstand the environmental stresses experienced while the clothing is being worn, most are very likely to be damaged if accidentally left in the pocket of clothes being washed. Due to the large number of personal cell phones in service, damage to such devices from being left in the laundry has become a rather common occurrence. Unless a load of laundry is thoroughly checked before loading into a washing machine, it is quite easy to accidentally ruin expensive electronic equipment.

SUMMARY OF THE INVENTION

In one aspect of the invention, a clothes washing machine (i.e., any machine for laundering clothes) is specially adapted to protect pocket-portable electronic devices from damage from a laundering process, such as exposure to soap and water from a wash cycle. A basket is aligned with an opening for receiving clothes to be washed. A door covers the opening during washing of clothes. An electromagnetic loop is positioned at the periphery of the opening so that all clothing loaded into the clothes washing machine passes through the electromagnetic loop. The electromagnetic loop is also positioned so that no permanent ferrous structures of the clothes washing machine are located between the electromagnetic loop and the opening. A detector circuit is coupled to the electromagnetic loop for generating an electronic detection signal in response to a predetermined change in an electromagnetic characteristic sensed across the electromagnetic loop corresponding to a pocket-portable electronic device being present at the opening. A washing machine controller coupled to the detector circuit responds to the detection signal to generate an alarm and to inhibit introduction of water into the basket until a user provides a manual override signal to the washing machine controller.

DETAILED DESCRIPTION OF PREFERRED EMBODIMENTS

Figure 1:
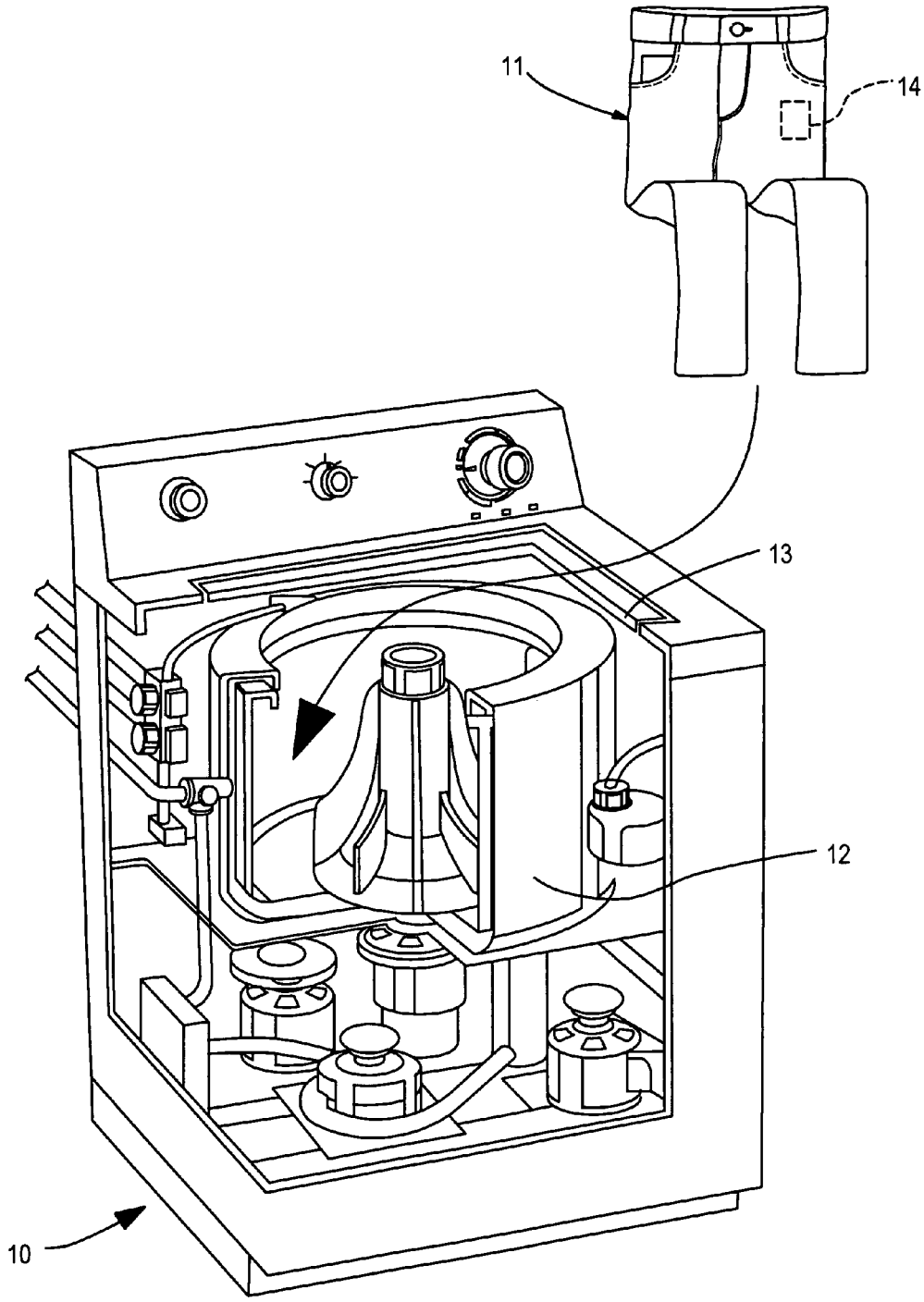
FIG. 1 is a partially-broken, perspective view of a clothes washing machine receiving laundry containing a pocket-portable device.

Referring to FIG. 1, a clothes washing machine 10 is used to wash a garment 11, such as a pair of pants. A basket 12 receives garment 11 through an opening 13. Although FIG. 1 shows a top-loading washer, the present invention is equally applicable to a front loading washer and to other types of laundry machines such as dryers (in which heat and mechanical shock can damage an electronic device).

During normal usage, basket 12 is filled with water and soap. Garment 11 has a pocket-portable electronic device 14 such as a cellular handset left in the pocket of garment 11 when loaded into washing machine 10. During a wash cycle, the water and soap can penetrate into device 14 causing damage.

The present invention detects the presence of the electronic device that has been accidentally placed in a washing machine, notifies the consumer of their mistake, and preferably interrupts the wash cycle until the consumer has checked the laundry load for electronic devices or simply chosen to override the warning and proceed with the wash cycle.

Figure 2:
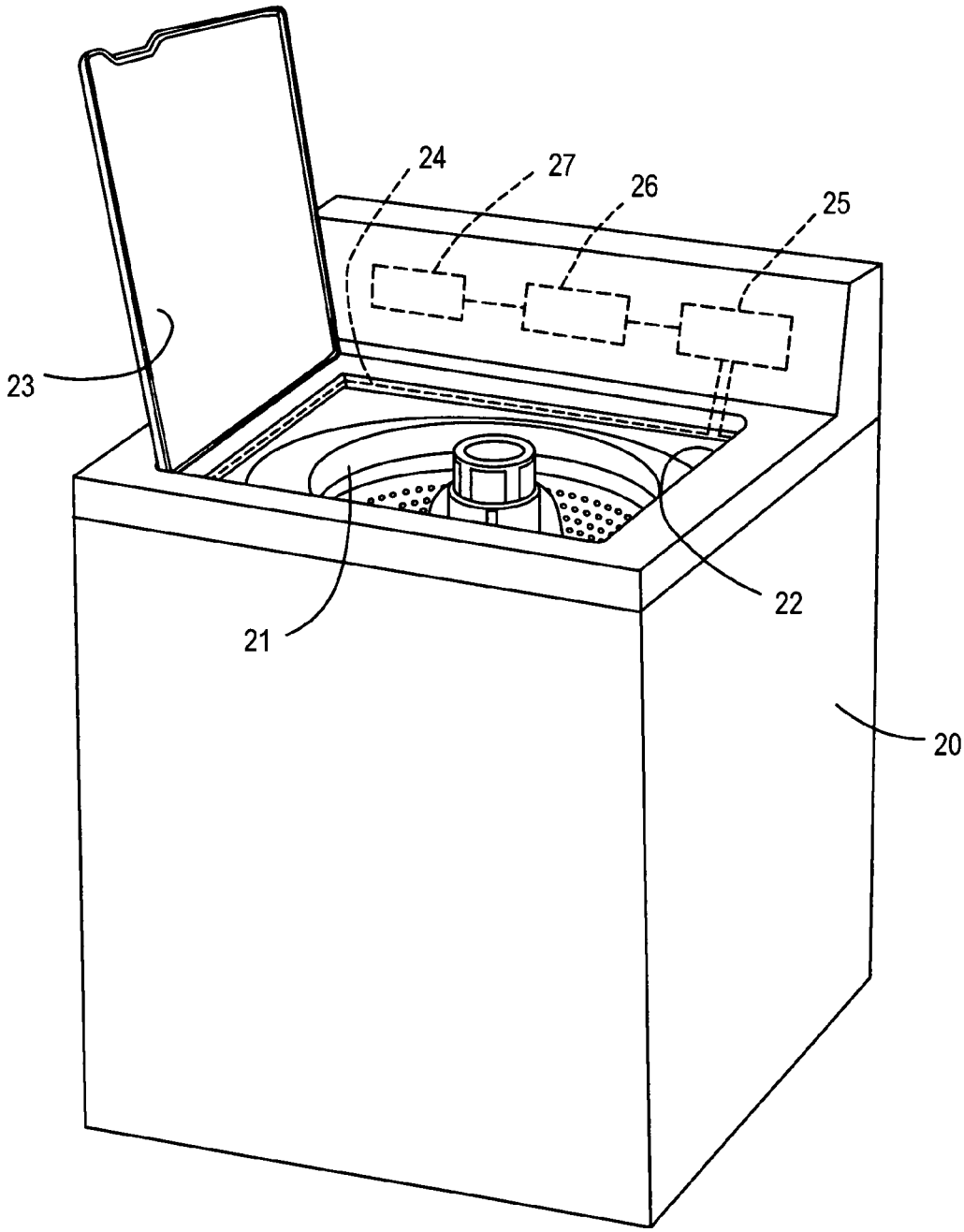
FIG. 2 is a perspective view showing a first embodiment of the invention for detecting pocket-portable devices being loaded into the washing machine.

FIG. 2 shows a first embodiment of the invention which does not require any modifications to the pocket-portable electronic device. A washer 20 has a basket 21 aligned with an opening 22 for receiving the clothes to be washed. A door 23 covers the opening during washing and is opened to reveal opening 22. An electromagnetic loop 24 is positioned at the periphery of opening 22 so that all clothing loaded into basket 21 passes through loop 24. When electronic devices pass through loop 24, predetermined changes are created in an electromagnetic characteristic which is sensed across electromagnetic loop 24 to indicate that a pocket-portable electronic device is about to be loaded into basket 21. So that the change in electromagnetic characteristic can be sensed, electromagnetic loop 24 is positioned such that no permanent ferrous structures of machine 20 are located between loop 24 and opening 22, which would otherwise shield the changes in the electromagnetic characteristic.

The sensed electromagnetic characteristic of electromagnetic loop 24 preferably comprises an inductance or a capacitance as measured across loop 24. The pocket-portable electronic devices include sufficient metallic or other conductive to surfaces (e.g., conductive layers on printed circuit boards, heat sink structures, or housings) that they interact electromagnetically with loop 24. Loop 24 is coupled to a detector circuit 25 for generating an electronic detection signal in response to the predetermined change in the electromagnetic characteristic across loop 24. A washing machine controller 26 receives all the normal user input settings and controls operation of the washing cycles including the generation of control signals for hot and cold water valves, a drain valve, and motor control signals. In addition, controller 26 receives the detection signal from detector circuit 25 in order to generate an alarm whenever a pocket-portable electronic device is potentially being loaded into washer 20. An alarm 27 coupled to controller 26 may comprise a sound transducer (e.g., a speaker) for generating an audible warning sound or a light source or display (e.g., an indicator light or a text display) for generating a visual warning. In addition to the alarm, controller 26 preferably inhibits a wash cycle (e.g., the introduction of water into basket 21) following a detection until the user provides a manual override signal to controller 26 indicating that the pocket-portable electronic device has been removed or that some other metallic object such as a zipper on a garment had triggered the detection.

Figure 3:
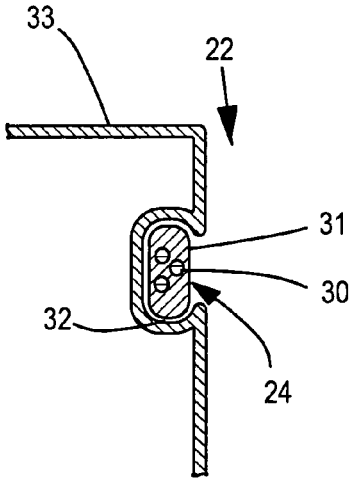
FIG. 3 is a side-cross sectional view showing mounting of an electromagnetic loop to the washing machine.

FIG. 3 shows one preferred embodiment of electromagnetic loop 24 in cross-section as mounted around the periphery of opening 22. Loop 24 is preferably isolated from any metal facade of the washer and is as close to opening 22 as possible. Preferably, a non-metallic trim piece 33 defines the vertical edges of opening 22 and may preferably comprise a molded thermoplastic or other nonconductive material (for a front loading machine the trim piece would define the horizontal edges). Loop 24 comprises one or more turns of an electrical conductor or wire 30 in the shape of a coil conforming to the opening 22 and covered by or embedded in an insulating jacket or matrix 31. Trim piece 33 includes a recess 32 for receiving electromagnetic loop 24 in a secure manner.

Figure 4:
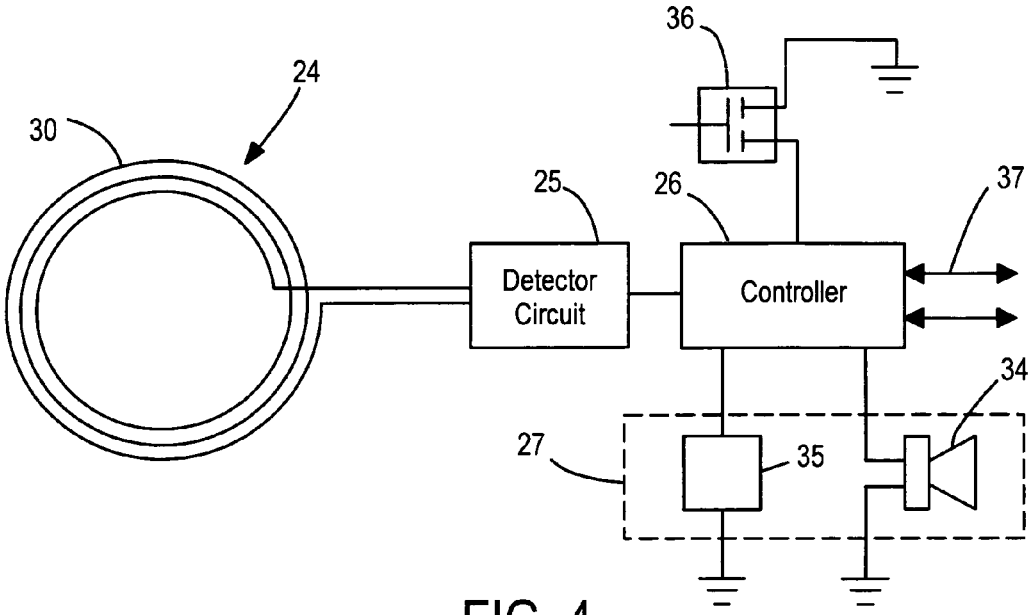
FIG. 4 is a schematic diagram showing the invention in greater detail.

The invention is shown in greater detail in FIG. 4. Loop 24 includes a coiled conductor 30 (shown for example with three turns) having the ends of loop 24 connected to detector circuit 25. In one embodiment, detector circuit 25 may connect coiled conductor 30 as part of a tuned circuit having a particular resonant frequency. When pocket-portable electronic devices pass through the plane of coiled conductor 30, the tuned circuit is detuned (i.e., the resonant frequency shifts) which can be detected by well known methods such as by comparing an output voltage of the tuned circuit to a fixed threshold. When the detuning is detected, a detection signal is transmitted to controller 26.

Controller 26 may preferably include all the conventional functions known for electronically controlled washing machines of the prior art. In addition, controller 26 is programmed to implement functions related to the present invention. Alarm 27 may include a speaker 34 to be used by controller 26 to generate an audible warning sound and a light source 35 used by controller 26 to generate a visual warning display. An override switch or push button 36 is also coupled to controller 26 to be manually activated by a user to generate the manual override signal to command controller 26 to proceed with a wash cycle. Controller 26 has further inputs and outputs 37 for interfacing with other components within the washing machine.

In operation, controller 26 preferably activates (i.e., turns on) detector circuit 25 whenever clothes are potentially being loaded into the washer (e.g., whenever the washer door is open). In response to a detection signal from detector circuit 25, controller 26 generates an alarm audibly using speaker 34 and/or visually using light source 35. In one preferred embodiment, the audible warning sound is generated for a predetermined period of time (such as for about 10 seconds) while the visual warning display is generated indefinitely until override switch 36 is manually pressed. In addition, controller 26 inhibits introduction of water into the basket in response to the detection signal until the user provides the manual override signal. More specifically, controller 26 will not initiate a wash cycle as long as an alarm is being generated. If the object within the washing machine is not an electronic device, then the user merely presses the override switch for the wash cycle to proceed. If the object is an electronic device, then the user presses the override switch after removing the electronic device.

Figure 5:
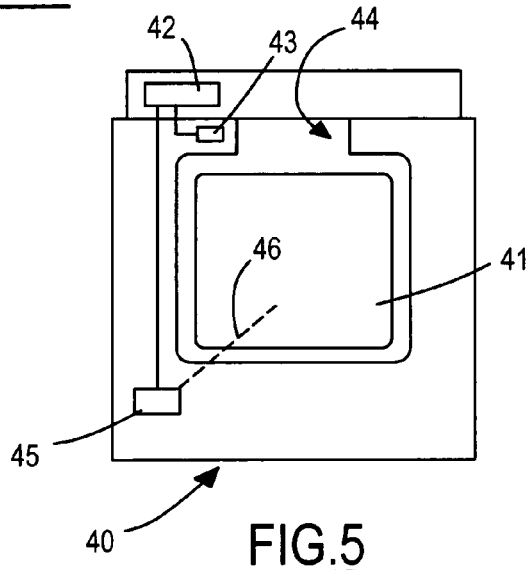
FIG. 5 is a block diagram showing an alternative embodiment of the invention wherein the washing machine broadcasts a message to the pocket-portable device.

An alternative embodiment of the invention wherein a washing machine 40 broadcasts an identification signal detectable within the washing machine by a pocket-portable electronic device accidentally placed within the washing machine as shown in FIG. 5. This embodiment requires the protected electronic device to have the capability to receive a broadcast and to detect information within the broadcast that indicates the presence of the electronic device within the washing machine.

Washing machine 40 includes a basket 41 for receiving clothes to be laundered and potentially receiving a pocket-portable electronic device accidentally left in the clothing. A washing machine controller 42 is coupled to a load detection sensor 43 for detecting times when laundry might be in the process of being loaded into basket 41. One example of load detection sensor 43 is a door position sensor located near opening 44 covered by a door (not shown) to detect an open condition of the door. Alternatively, a weight sensor in connection with basket 41 may detect the addition of weight into basket 41 as an indication of laundry being loaded. A local transmitter 45 is coupled to controller 42 in order to broadcast a radiofrequency (RF) identification signal substantially only within the washing machine 40. For example, transmitter 45 may be a Bluetooth node transmitting a Bluetooth signal 46. The RF identification signal is receivable by a pocket-portable electronic device within basket 41 which thereby determines that it is within clothes washing machine 40 and that the electronic device should take a defensive measure. Preferably, the defensive measure includes generating a device alarm such as an audible warning sound to inform the user of the inadvertent placement of the electronic device within washing machine 40.

Figure 6:
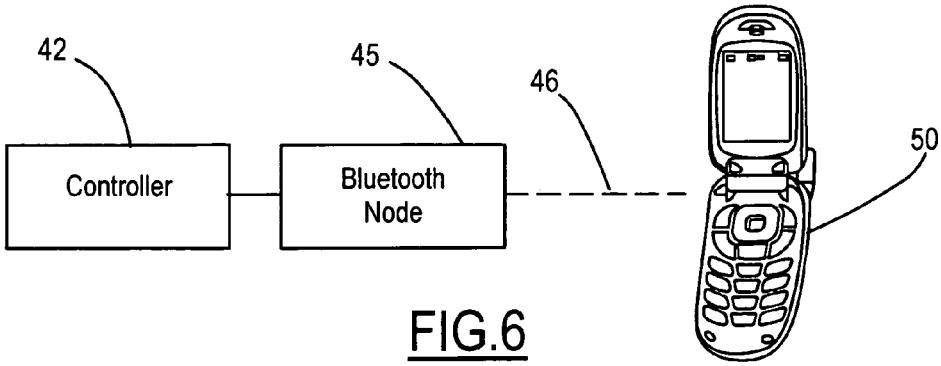
FIG. 6 is a block diagram showing the embodiment of FIG. 5 in greater detail.

As shown in FIG. 6, Bluetooth node 45 may interact with a cellular phone 50 since conventional cellular phones typically already include Bluetooth capability. Bluetooth node 45 preferably utilizes a transmission power and has an antenna placement within the metallic shell of a conventional washing machine that limits reception of a Bluetooth broadcast to within the confines of the washing machine. Broadcast 46 from Bluetooth node 45 preferably includes a message containing data (such as a Bluetooth profile) that is recognizable by device 50 as being associated with a Bluetooth node located within a clothes washer. Such message would be an agreed upon standard message defined as a Bluetooth profile for washing machines. Based on the recognition of the message, device 50 generates a device alarm such as a continuous ring so that the user will remove device 50 before initiating a wash cycle. Alternatively, a return message from device 50 to controller 42 via Bluetooth node 45 can be provided so that controller 42 inhibits the initiation of a wash cycle automatically.

In addition to Bluetooth communication, any other conventional short range wireless communication can be employed. However, a matching receiver needs to be present in the pocket-portable electronic devices in order for them to be protected.

What is claimed is:

1. A clothes washing machine providing protection of pocket-portable electronic devices from damage, comprising:

a basket aligned with an opening for receiving clothes to be washed;

a door for covering the opening during washing of clothes;

an electromagnetic loop positioned at the periphery of the opening so that all clothing loaded into the clothes washing machine passes through the electromagnetic loop, the electromagnetic loop being positioned so that no permanent ferrous structures of the clothes washing machine are located between the electromagnetic loop and the opening;

a detector circuit coupled to the electromagnetic loop for generating an electronic detection signal in response to a predetermined change in an electromagnetic characteristic sensed across the electromagnetic loop corresponding to a pocket-portable electronic device being present at the opening; and a washing machine controller coupled to the detector circuit and responsive to the detection signal to generate an alarm and to inhibit a cycle of the machine until a user provides a manual override signal to the washing machine controller.

2. The clothes washing machine of claim 1 wherein the electromagnetic loop is comprised of a coiled conductor covered by an insulating jacket.

3. The clothes washing machine of claim 1 wherein the electromagnetic characteristic sensed by the detector circuit is comprised of an inductance sensed across the electromagnetic loop.

4. The clothes washing machine of claim 1 wherein the electromagnetic characteristic sensed by the detector circuit is comprised of a capacitance sensed across the electromagnetic loop.

5. The clothes washing machine of claim 1 wherein the alarm is comprised of an audible warning sound.

6. The clothes washing machine of claim 1 wherein the alarm is comprised of a visual warning display.

7. The clothes washing machine of claim 1 further comprising an override switch coupled to the washing machine controller for generating the manual override signal.

8. The clothes washing machine of claim 1 further comprising a transmitter for transmitting an RF identification signal substantially only within the clothes washing machine, the RF identification signal being receivable by a pocket-portable electronic device within the basket in order to identify that it is within the clothes washing machine and that the pocket-portable electronic device should take a defensive measure, including generating a device alarm.

9. The clothes washing machine of claim 8 wherein the transmitter is comprised of a Bluetooth transmitter that transmits a message within the basket informing any properly-adapted pocket-portable electronic device that it is resident within a clothes washing machine.

10. A method of protecting pocket-portable electronic devices from a harsh environment in a clothes washing machine having a basket aligned with an opening for receiving clothes to be washed and a door for covering the opening during washing of clothes, the method comprising the steps of:

locating an electromagnetic loop at the periphery of the opening;

sensing changes in an electromagnetic characteristic at the opening corresponding to a pocket-portable electronic device being present at the opening;

generating an alarm in response to the sensed changes; and inhibiting a cycle of the clothes washing machine in response to the sensed changes until a user provides a manual override signal.

11. The method of claim 10 wherein the electromagnetic characteristic is comprised of an inductance sensed across the electromagnetic loop.

12. The method of claim 10 wherein the electromagnetic characteristic is comprised of a capacitance sensed across the electromagnetic loop.

13. The method of claim 10 wherein the alarm is comprised of an audible warning sound.

14. The method of claim 10 wherein the alarm is comprised of a visual warning display.

15. The method of claim 10 further comprising the steps of:

transmitting an RF identification signal substantially only within the clothes washing machine;

receiving the RF identification signal at a pocket-portable electronic device within the basket in order to identify that it is within the clothes washing machine; and the pocket-portable electronic device taking a defensive measure, including generating a device alarm.

16. The method of claim 15 wherein the RF identification signal is comprised of a Bluetooth message informing any properly-adapted pocket-portable electronic device that it is resident within a clothes washing machine.

17. A method of protecting pocket-portable electronic devices from a harsh environment in a clothes washing machine having a basket aligned with an opening for receiving clothes to be washed and a door for covering the opening during washing of clothes, the method comprising the steps of:

the clothes machine detecting the loading of clothes in the basket;

the clothes machine broadcasting an RF identification signal substantially only within the clothes washing machine;

a pocket-portable electronic device within the basket receiving the RF identification signal, thereby determining that it is within the clothes washing machine; and the pocket-portable electronic device taking a defensive measure, including generating a device alarm.

18. The method of claim 17 wherein the RF identification signal is comprised of a Bluetooth message informing any properly-adapted pocket-portable electronic device that it is resident within a clothes washing machine.

19. The method of claim 17 wherein the pocket-portable electronic device is comprised of a mobile telephone, and wherein the device alarm is comprised of a continuous ring.

* * * * *